US006971347B1

(12) United States Patent
Sun

(10) Patent No.: US 6,971,347 B1
(45) Date of Patent: Dec. 6, 2005

(54) ELECTROHYDRAULIC VALVE ACTUATOR ASSEMBLY

(75) Inventor: Zongxuan Sun, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/964,138

(22) Filed: Oct. 13, 2004

Related U.S. Application Data

(60) Provisional application No. 60/587,321, filed on Jul. 13, 2004.

(51) Int. Cl.[7] ..... F01L 9/02
(52) U.S. Cl. ..... 123/90.12; 123/90.15; 123/90.13
(58) Field of Search ..... 123/90.15, 90.12, 123/90.13

(56) References Cited

U.S. PATENT DOCUMENTS 5,421,545 A * 6/1995 Schexnayder ..... 251/30.02
5,456,222 A 10/1995 Schechter ..... 123/90.12
5,638,781 A 6/1997 Sturman ..... 123/90.12
6,109,284 A 8/2000 Johnson et al. ..... 137/1
6,263,842 B1 7/2001 De Ojeda et al. ..... 123/90.12

OTHER PUBLICATIONS

SAE Technical Paper Serial 2002-01-1109, "Production Elector-Hydraulic Variable Valve-Train for a New Generation of I.C. Engines", Jeff Allen and Don Law; Mar. 4-7, 2002; pp 9.

* cited by examiner

*Primary Examiner*—Thomas Denion
*Assistant Examiner*—Zelalem Eshete
(74) *Attorney, Agent, or Firm*—Kathryn A. Marra

(57) ABSTRACT

A value actuator assembly for an engine includes a movable engine valve a movable spool valve and dual feedback channels with flow regulated by a pair of orifices. The valve actuator assembly also includes a driving channel interconnecting the spool valve and the engine valve. The feedback channels interconnecting the engine valve and the spool valve. First and second feedback channels communicate between the second and third fluid chambers and fourth and fifth fluid chambers of the spool valve. Orifices restrict fluid flow through the feedback channels as needed to actuate the spool valve and thereby improve valve controllability.

11 Claims, 3 Drawing Sheets

ELECTROHYDRAULIC VALVE ACTUATOR ASSEMBLY

CROSS-REFERENCE TO RELATED APPLICATIONS

This application claims priority from U.S. Provisional Patent Application No. 60/587,321 filed Jul. 13, 2004.

TECHNICAL FIELD

This invention relates to engine valvetrains and, more particularly, to an electrohydraulic valve actuator assembly for an internal combustion engine.

BACKGROUND OF THE INVENTION

Valve actuator assemblies for camless valvetrains of internal combustion engines have been proposed in the art. Such actuators often result high energy consumption, low repeatability from cycle to cycle and cylinder to cylinder and high seating velocity-induced noise. Some valve actuator assemblies do not provide full capability of variable lift. They may also be of relatively high cost and have large packaging size.

It is desirable to provide an engine valve actuator assembly that improves controllability. It is also desirable to provide a valve actuator assembly having increased flexibility and full capacity for variable lift. Further, it is desirable to provide a valve actuator assembly that reduces energy consumption and provides satisfactory seating velocity. Therefore, there is a need in the art to provide a valve actuator assembly for an engine that meets these desires.

SUMMARY OF THE INVENTION

The present invention provides a new camless engine valve actuator assembly that has internal feedback for improved controllability.

The valve actuator assembly includes a movable engine valve, a movable spool valve, a driving channel interconnecting the spool valve and the engine valve and dual feedback channels having a pair of flow regulating orifices. The feedback channels interconnect the engine valve and the spool valve.

The spool valve controls fluid flow to the driving channel to position the engine valve. The orifices regulate feedback fluid pressure to the spool valve to provide internal feedback for valve controllability and flow control.

An advantage of the present invention is that the valve actuator assembly has dual hydraulic feedback for precise motion. Another advantage is that the valve actuator assembly provides improved valvetrain stability without sacrificing dynamic performance. The valve actuator assembly also enables improved engine performance and fuel economy and lower engine emissions by improved valve control. The valve actuator assembly minimizes energy consumption by optimized flow control, a simple spool valve and efficient valve control to minimize throttling of the fluid flow. The spool valve and the first and second orifices create dual feedback to provide both precise valve lift control and soft valve landing. Another advantage of the valve actuator assembly of the present invention is that it is of relatively small size and easy to package in an engine. Another advantage of the present invention is that it has relatively less contents and therefore lower cost.

These and other features and advantages of the invention will be more fully understood from the following description of certain specific embodiments of the invention taken together with the accompanying drawings.

DESCRIPTION OF THE PREFERRED EMBODIMENT

Figure 1:
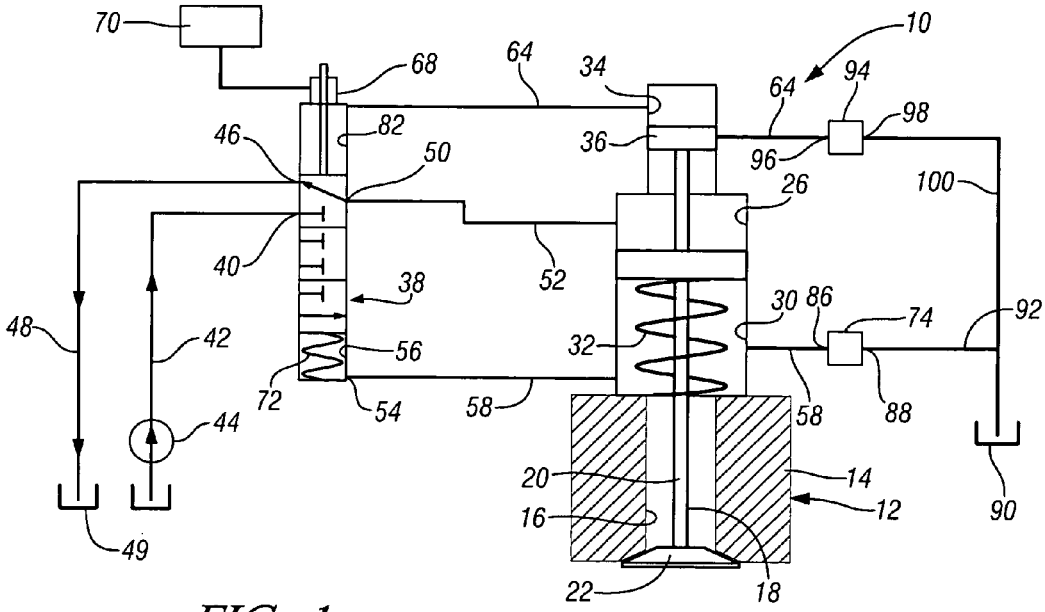
FIG. 1 is a diagrammatic view of a valve actuator assembly, according to the present invention, illustrated in operational relationship with an engine of a vehicle.
Figure 2:
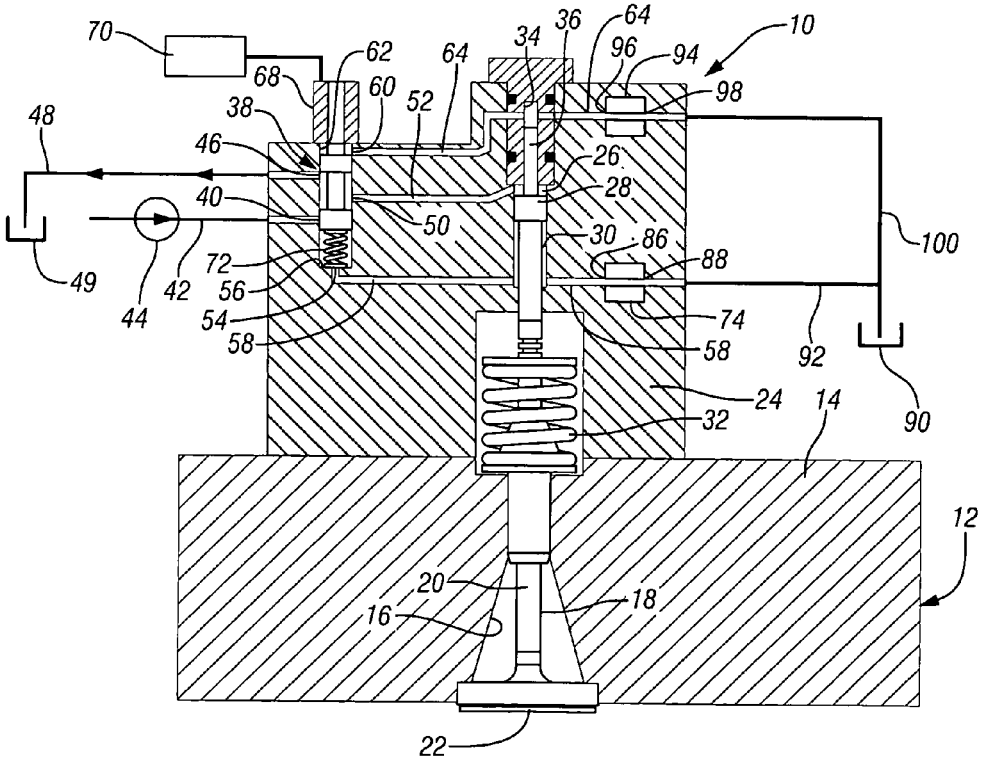
FIG. 2 is a cross-sectional view of the valve actuator assembly of FIG. 1 in an engine valve closed position.

Referring first to FIGS. 1 and 2 of the drawings in detail, numeral 10 generally indicates an electrohydraulic valve actuator assembly mounted on a cylinder head 12 including at least one opening 16 in communication with an internal combustion chamber, not shown, of the engine. The cylinder head 12 also includes a movable engine valve 18 for each opening 16. The engine valve 18 has a valve stem 20 and a valve head 22 at one end of the valve stem. The engine valve 18 is movable between open and closed positions within its respective opening 16. It should be understood that the engine valve 18 may be either an intake or an exhaust valve.

The valve actuator assembly 10 further includes a valve housing 24 disposed adjacent the cylinder head 12. The valve housing 24 has a main or first fluid chamber 26 therein. A first piston 28 is connected to or in contact with the valve stem 20 of the engine valve 18. The piston 28 is disposed in the first fluid chamber 26 of the valve housing 24 and forms a second fluid chamber 30 therein. An engine valve spring 32 is disposed about the valve stem 20 and contacts the cylinder head 12 to bias the engine valve 18 toward the closed position so that the valve head 22 closes the opening 16, as shown in FIG. 2.

The valve actuator assembly 10 further includes a third fluid chamber 34 axially spaced from the first fluid chamber 26 and defined by the housing 24. A second piston 36, connected to the first piston 28, is disposed in the third fluid chamber 34.

The valve actuator assembly 10 also includes a spool valve 38 fluidly connected to the first fluid chamber 26 of the valve housing 24. The spool valve 38 is of a three position three-way type. The spool valve 38 has a high pressure port 40 fluidly connected by an intermediate channel 42 to a fluid pump 44 and a low pressure port 46 fluidly connected by second intermediate channel 48 to a fluid tank 49. If desired, the fluid pump 44 may be fluidly connected to the fluid tank 49 or a separate fluid tank.

The spool valve 38 further includes a third port 50 fluidly connected by a driving channel 52 to the first fluid chamber 26. The spool valve 38 also has a fourth port 54 fluidly connecting a fourth chamber 56 to the second fluid chamber 30 of the valve housing 24 via a first feedback channel 58 and a fifth port 60 fluidly connecting a fifth chamber 62 via a second feedback channel 64 to the third fluid chamber 34. The spool valve 38 is operable to control fluid flow to and from the first fluid chamber 26.

The spool valve 38 also includes an actuator 68 at one end of the spool valve 38 adjacent the fifth chamber 62. The actuator 68 is of a linear type, such as a solenoid, electrically connected to a source of electrical power, such as a controller 70. The spool valve 38 further includes a spool valve spring 72 disposed in the fourth chamber 56 to bias the spool valve toward the actuator 68. The controller 70 energizes and de-energizes the actuator 68 to move the first spool valve 38.

The spool valve spring 72 is operative to bias the spool valve 38 toward the actuator 68 when fluid pressures in the fourth and fifth chambers 56 and 62 are equal. However, a pressure differential between the fourth or the fifth chambers 56 and 62 may be able to overcome the force of the spool valve spring 72.

The valve actuator assembly 10 further includes a first orifice 74 fluidly connected to the second fluid chamber 30 of the valve housing 24. The orifice 74 has first and second ports 86, 88. The first port 86 is fluidly connected by the first feedback channel 58 to the second fluid chamber 30. The second port 88 is fluidly connected to a fluid tank 90 by a low pressure line 92. It should be appreciated that the fluid tank 90 is able to maintain certain level of back pressure.

The valve actuator assembly 10 further includes a second orifice 94 fluidly connected to the third fluid chamber 34 of the valve housing 24. The orifice 94 has first and second ports 96, 98. The first port 96 is fluidly connected by the second feedback channel 64 to the third fluid chamber 34. The second port 98 is fluidly connected to the fluid tank 90 by a low pressure line 100. If desired, the low pressure line 100 may be fluidly connected to a separate fluid tank, not shown.

It should be appreciated, that the size and flow rates of the orifices 74 and 94 will vary depending on the application. One skilled in the art may determine the optimal sizes of the orifices 74, 94 using the following equation, $$Q=KA\sqrt{\Delta P}, \text{ where:}$$

Q equals the flow rate;

K is a constant;

A is the area of the orifice; and $\Delta P$ is the pressure drop across the orifice.

The orifices 74 and 94 must be sized to allow adequate fluid flow to and from the second and third chambers 30 and 34 during engine valve 18 actuation to allow the engine valve to properly open and close. However, the amount of fluid flow through the orifices 74 and 94 should be limited to create sufficient backpressures in the first and second feedback channels 58 and 64 to actuate the spool valve 38 and thereby control the opening and closing velocities of the engine valve 18.

In operation, as illustrated by FIG. 2, the engine valve 18 is shown in the closed position. In this position, the controller 70 de-energizes the actuator 68. This allows the spool valve spring 72 to move the spool valve 38 toward the actuator, closing the high pressure port 40 and opening the low pressure port 46. This communicates the first chamber 26 with the fluid tank 49 via the low pressure port 46 and allows the engine valve spring 32 to keep the engine valve 18 closed with the valve head 22 closing the opening 16.

Figure 3:
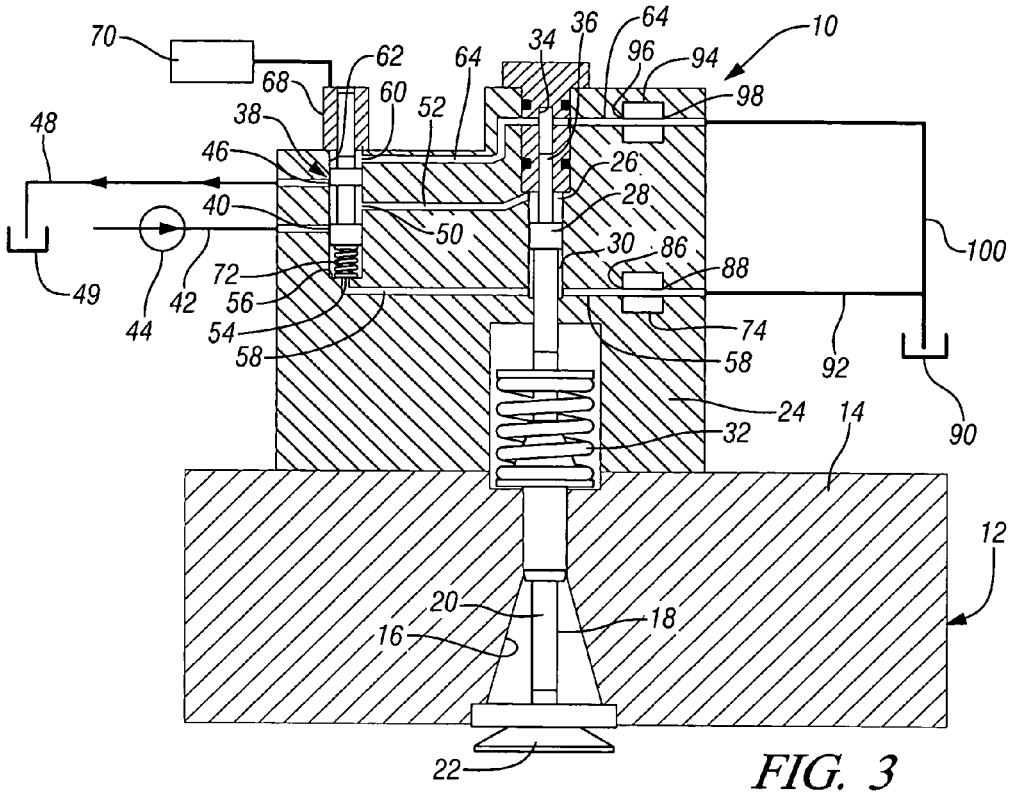
FIG. 3 is a similar view of the valve actuator assembly of FIG. 1 in an engine valve opening position.

To open the engine valve 18, as illustrated in FIG. 3, the controller 70 energizes the actuator 68 to drive the spool valve 38 against the spool valve spring 72 closing the low pressure port 46 and opening the high pressure port 40. This allows high pressure fluid to flow from the pump 44 through the spool valve 38 into the first chamber 26. The fluid pressure acts against the first piston 28 to overcome the force of the engine valve spring 32 and open the engine valve 18.

As the engine valve 18 opens, the first piston 28 displaces fluid from the second chamber 30 into the first feedback channel 58. The release of fluid from the first feedback channel 58 to the fluid tank 90 is regulated by the first orifice 74. This controls the opening velocity of the engine valve 18 by restricting fluid flow through the first orifice 74 to increase the fluid pressure within the first feedback channel 58 and the fourth chamber 56 of the spool valve 38. The increased fluid pressure within the fourth chamber 56 drives the spool valve 38 upward against the actuator 68 and into the fifth fluid chamber 62, thereby limiting or temporarily cutting off the connection between the driving channel 52 and the intermediate channel 42. This reduces fluid pressure supplied to the first chamber 26 and slows the opening velocity of the engine valve 18. As the opening velocity of the engine valve 18 is reduced, the amount of displaced fluid from the second chamber 30 to the first feedback channel 58 is reduced, thereby reducing fluid pressure within the fourth chamber 56. Thus, allowing the actuator 68 to drive the spool valve 38 downward into the fourth chamber 56 and increase fluid flow between the intermediate channel 42 and the driving channel 52.

Figure 4:
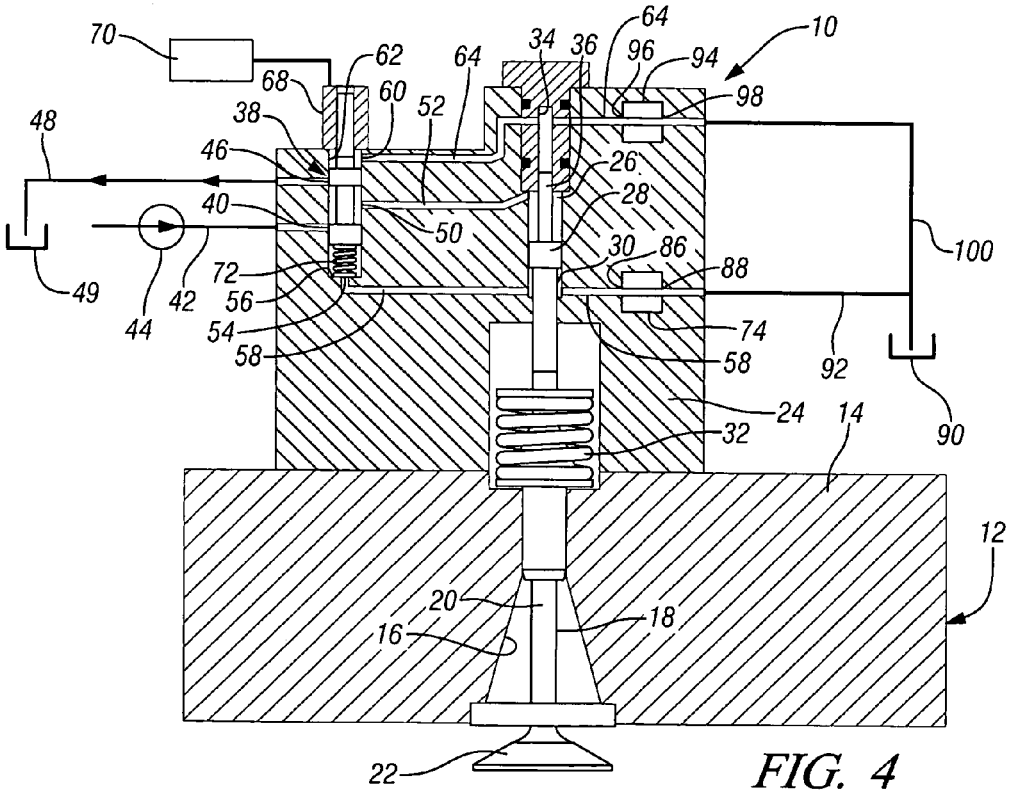
FIG. 4 is a similar view of the valve actuator assembly of FIG. 1 in an engine valve opened position.

To stop the engine valve 18 at a predetermined lift position, as shown in FIG. 4, the controller 70 energizes the actuator 68 to move the spool valve 38 to a neutral position that closes communication between the high and low pressure ports 40, 46 from the third port 50 of the spool valve 38 to seal the first fluid chamber and thereby maintain the position of the first piston 28. It should be understood, the lift height of the engine valve 18 is determined by the timing of the closing of the spool valve 38.

Figure 5:
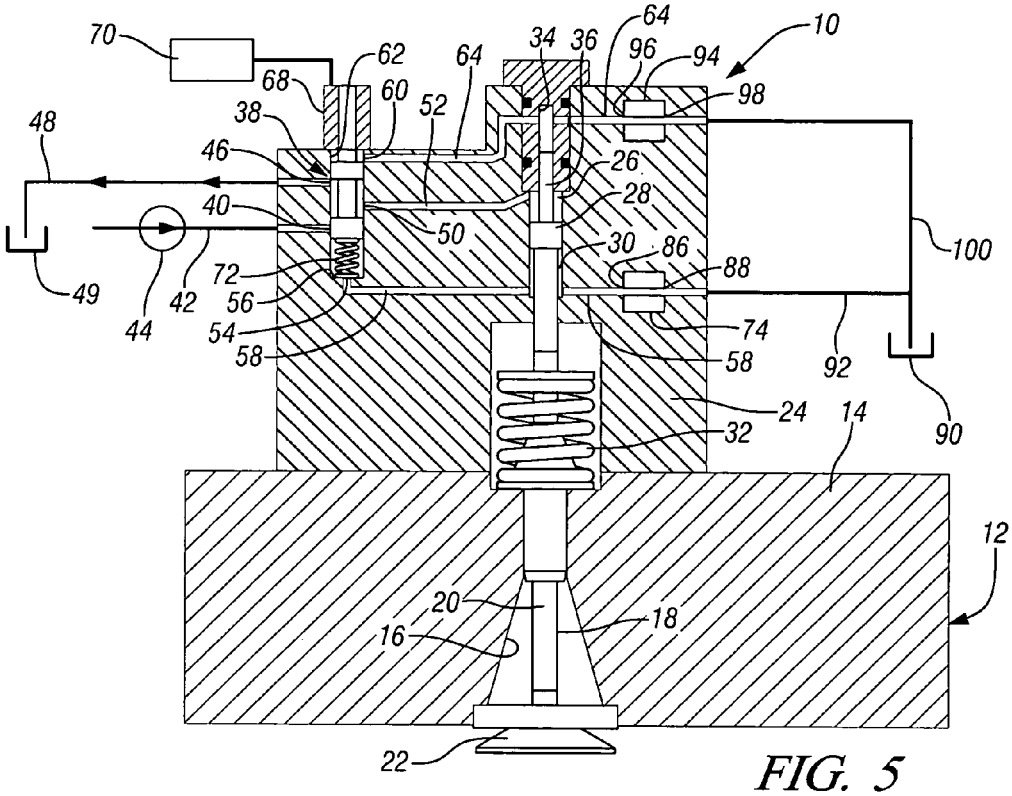
FIG. 5 is a similar view of the valve actuator assembly of FIG. 1 in an engine valve closing position.

To close the engine valve 18, the controller 70 de-energizes the actuator 68. The spool valve spring 72 returns the spool valve 38 to a position which communicates the first chamber 26 with the second intermediate channel 48 and the fluid tank 49. This allows the high pressure fluid in the first chamber 26 to exhaust into the fluid tank 49. The engine valve spring 32 then drives the engine valve 18 upward, as illustrated in FIG. 5. The second fluid chamber and the third fluid chamber 30 and 34 are connected with the tank 90 so that, as the engine valve 18 returns to the closed position, low pressure fluid refills the second fluid chamber from the third fluid chamber and to the tank 90.

Figure 6:
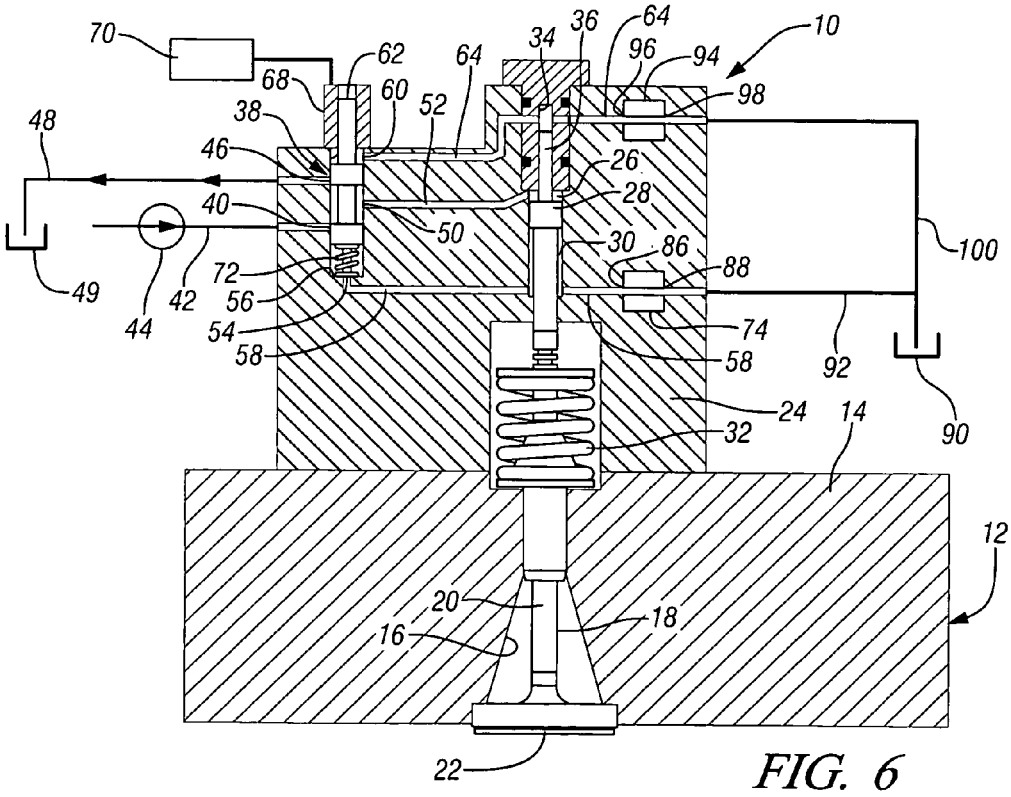
FIG. 6 is a similar view of the valve actuator assembly of FIG. 1 in an engine valve closed position.

The second orifice 94 provides a "soft landing" as the engine valve 18 returns to the closed position by limiting fluid flow between the third fluid chamber 34 and the tank 90. Particularly, as the upward moving engine valve 18 displaces fluid from the third chamber 34 to the second feedback channel 64, the second orifice 94 creates backpressure to increase fluid pressure within feedback channel and the fifth chamber 62 of the spool valve 38. The fluid pressure in the fifth chamber 62 drives the spool valve 38 downward against the spool valve spring 72 until the spool valve it cuts off or reduces flow through the connection between the driving channel 52 and the intermediate channel 48, as illustrated in FIG. 6. During this time, fluid within the second feedback channel 64 continues to flow through the second orifice 94 maintaining a fluid backpressure within the second feedback channel and the fifth chamber 62. This allows the spool valve spring 72 to return the spool valve to its initial position and the engine valve spring 32 to return the engine valve 18 to the closed position at a controlled velocity.

The valve actuator assembly 10 has better controllability by utilizing the hydraulic feedback channels 58 and 64 and the orifices 74 and 94 are used to restrict flow through the feedback channels. The better controllability enables the valve actuator assembly 10 to provide better performance. The valve actuator assembly 10 of the present invention precisely controls the motion of the spool valve 38 though the feedback channels 58 and 64 so that it avoids unnecessary throttling of the low pressure flow and high pressure flow, thereby providing energy consumption benefits.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve actuator assembly for an internal combustion engine, the assembly comprising:

a movable engine valve;

a movable spool valve;

a spring biasing the engine valve to a closed position;

a driving channel interconnecting the spool valve and the engine valve;

a first feedback channel interconnecting the engine valve, the spool valve and a first orifice;

a second feedback channel interconnecting the engine valve, the spool valve and a second orifice; and an actuator operatively cooperating with the spool valve to position the spool valve to prevent and allow flow through the driving channel to position the engine valve;

the first and second orifices restrict flow through the feedback channels to control the motion of the spool valve.

2. A valve actuator assembly as in claim 1 including a valve housing having a first fluid chamber fluidly communicating with the driving channel and a second fluid chamber fluidly communicating with the first feedback channel.

3. A valve actuator assembly as in claim 2 including a first piston operatively cooperating with the engine valve and movably disposed in the valve housing operatively between the first fluid chamber and the second fluid chamber.

4. A valve actuator assembly as in claim 2 wherein the first feedback channel interconnects the second fluid chamber and a fourth fluid chamber of the spool valve.

5. A valve actuator assembly as in claim 2 wherein the valve housing has a third fluid chamber fluidly communicating with the second feedback channel.

6. A valve actuator assembly as in claim 5 including a second piston operatively cooperating with the engine valve and disposed in the valve housing, one side of the second piston being open to a third fluid chamber.

7. A valve actuator assembly as in claim 6 wherein the second feedback channel interconnects the third fluid chamber with a fifth fluid chamber of the spool valve.

8. A valve actuator assembly as in claim 1 including a fourth fluid chamber at one end of the spool valve and fluidly communicating with the first feedback channel and a fifth fluid chamber at an opposite end of the spool valve and fluidly communicating with the second feedback channel.

9. A valve actuator assembly as in claim 8 including a first spool valve spring biasing the spool toward the fifth fluid chamber.

10. A valve actuator assembly as in claim 1 including a controller electronically connected to the actuator to energize and de-energize actuator.

11. A method of operating a valve actuator assembly for an engine, including the steps of:

providing a movable engine valve;

providing an engine valve spring biasing the engine valve toward a closed position;

providing a movable spool valve;

providing a first and second feedback channels interconnecting the engine valve and the spool valve and first and second orifices operable to control fluid flow through the first and second feedback channels;

actuating the spool valve to position the spool valve to an open position to supply high pressure fluid to a driving channel interconnecting the spool valve and the engine valve with high pressure fluid to move the engine valve to an open position;

supplying a first feedback channel interconnecting the spool valve and the engine valve with fluid flow;

supplying a second feedback channel interconnecting the spool valve and the engine valve with fluid flow; and restricting fluid flow through the first feedback channel via the first orifice and restricting fluid flow through the second feedback channel via the second orifice, thereby controlling motion of the spool valve.

* * * * *